United States Patent [19]

Fassman

[11] Patent Number: 4,946,342

[45] Date of Patent: Aug. 7, 1990

[54] ARTICLE POSITIONING DEVICE

[76] Inventor: Arnold Fassman, 40 Oak St., Westport, Conn. 06880

[21] Appl. No.: 311,172

[22] Filed: Feb. 15, 1989

[51] Int. Cl.[5] ..... B65G 59/12

[52] U.S. Cl. ..... 414/798.9; 198/459; 221/185; 221/232; 446/2

[58] Field of Search ..... 414/417, 509, 512, 518, 414/521, 525.1, 24.5, 798.9, 799; 198/459, 463.6; 221/185, 226, 232, 273, 274; 446/2; 273/148 R

[56] References Cited

U.S. PATENT DOCUMENTS

| | | | |
|---|---|---|---|
| 3,332,529 | 7/1967 | Penzias | 198/459 |
| 3,667,622 | 6/1972 | Kamphues et al. | 198/459 X |
| 3,828,970 | 8/1974 | Yamamoto | 221/24 |
| 3,908,846 | 9/1975 | Brummitt | 414/24.5 |
| 4,193,512 | 3/1980 | Buxton et al. | 221/185 |
| 4,245,756 | 1/1981 | Byrne et al. | 221/185 |
| 4,341,411 | 7/1982 | Edwards | 414/24.5 X |
| 4,438,586 | 3/1984 | Wildman et al. | 446/2 |
| 4,610,346 | 9/1986 | Phillipson | 414/798.9 X |
| 4,854,802 | 8/1989 | de Groot | 414/518 X |

*Primary Examiner*—Robert J. Spar
*Assistant Examiner*—John Vanden Bosche

[57] ABSTRACT

A device for positioning a plurality of generally elongate objects such as dominos on a flat surface in upstanding orientation and in evenly spaced relationship with each other includes an elongate structure for storing a plurality of dominos in face to face relationship with the dominos standing upright on the flat surface on which they will be positioned in spaced relationship as the device moves intermittently across the surface. A domino discharge mechanism is mounted in the storage means to discharge a domino therefrom each time the discharge mechanism is actuated. The device also includes a drive means for moving it across a flat surface in intermittent manner, and an actuating mechanism operable to actuate the discharge mechanism during intervals when the device is stationary.

18 Claims, 8 Drawing Sheets

ARTICLE POSITIONING DEVICE

BACKGROUND OF THE INVENTION

This invention is an improvement on the invention disclosed and claimed in my prior U.S. Pat. No. 4,245,756, issued Jan. 20, 1981.

The primary purpose of the device covered by my prior patent is to set up dominos in the form of a row of closely spaced upstanding dominos so that they can be progressively knocked down. The primary purpose of the present invention is to make substantial improvements both in the quality of the operation of the earlier device and in the quantity of dominos which can be set up in any given time.

In the Background of the Invention portion of the specification of my prior patent, there is set forth a detailed discussion of the nature of the well known recreational activity of setting up dominos in a long row and in closely spaced relationship so that all of the dominos can be knocked down by merely pushing over the first domino in the row. That discussion also covers the problems typically encountered in setting up the dominos. In view of the length and detail of that discussion, it is not deemed necessary to repeat it herein, but rather it is included by reference since it is as applicable to the current invention as it was to the prior invention.

The device of the previous patent was clearly an improvement over the earlier method of setting up dominos, which was to set them up one by one by hand. The disadvantages of this procedure are fully discussed in the prior patent. However, even that device had its limitations and certain inherent disadvantages which tended to offset the advantages thereof. For one thing, the storage capacity of the prior device was somewhat limited in that the supply hopper can hold only a limited number of dominos because they are stacked vertically one on top of another. Since there is a practical to the height of the supply hopper without the device becoming unwieldy or top heavy, the device could probably not accommodate more than about ten to twelve dominos. Thus, each time the device dispensed that number of dominos, it had to be reloaded.

Another factor which severely limited the domino positioning capacity of the prior device is that it could only set up one row of dominos at a time. This not only limited the overall set up capacity, it also placed a limit on how close one row of dominos could be to the next. It is obvious that the rows of dominos could not be spaced more closely than one half the width of the domino placing device, otherwise the wheels of the device would not clear the row already set up while setting up a new row. This deficiency in the prior device can create a serious space problem when it is desired to set up a complex pattern of many hundreds or thousands of dominos in a limited amount of space.

A further disadvantage of my prior invention is in the mechanical complexity of the drive connection between the large supportive wheels and the domino ejecting device so that the domino is ejected from the rear end of the device at the exact same speed at which the device is moving forwardly across a surface. The necessity for this is so that the domino is stationary with respect to the supporting surface at the moment it is ejected from the device in order to assure that it remains in an upstanding position. This is critical because of the nature of dominos, in that they are typically tall and thin, and therefore are very unstable in the directions facing either of the broad faces. Any abrupt change in the rate of movement of the domino as it moves from the floor of the ejecting chamber onto the supporting surface increases the likelihood that the domino will fall over. If it does, and if it should fall in the direction of dominos already ejected and positioned upright in a row, these will fall and the entire pattern of dominos already set up will have to be redone.

The only other domino positioning device of which I am aware is that shown in prior U.S. Pat. No. 4,193,512 issued Mar. 18, 1980. As is immediately apparent from the specification of this patent, the device is hand held and is adapted to store a certain quantity of dominos and to position them in upstanding relationship as the device is moved across a supporting surface. However, the nature of the positioning mechanism is such that it requires specially made dominos which have a supporting base construction which cooperates with certain portions of the positioning device to hold the dominos in a radial position relative to the positioning device while they are being moved from a storage means to the supporting surface. This device will not function at all with standard dominos. Thus it is entirely impractical from the standpoint of using it to set up a complex pattern containing hundreds of dominos. It also suffers the disadvantage of having limited capacity to set up dominoes because of limited storage space and only setting up one row at a time.

BRIEF SUMMARY OF THE INVENTION

The present invention obviates or completely overcomes the foregoing objections of my prior domino positioning device without sacrificing any of the benefits and advantages thereof, and also provides advantages and features not contemplated in the design of the prior device.

Generally speaking, the present invention relates broadly to the field of article positioning devices, and more particularly to a device which positions on a surface a plurality of elongate articles in upstanding relationship and evenly spaced from one another.

In their broader aspects, the principles of the present invention are embodied in a device for positioning a plurality of generally elongate articles on a flat surface in an upstanding orientation and in evenly spaced relationship with each other. The device includes an elongate article storage means which is disposed in a generally horizontal orientation for storing a plurality of the articles in upstanding orientation. An article discharge means is operatively associated with the storage means for causing articles to be sequentially discharged from one end of the storage means while it is stationary relative to the supporting surface. There is also included a means operatively associated with the storage means for intermittently moving the storage means across the supporting surface in predetermined increments of movement. By this arrangement, successive articles are deposited on the supporting surface in upstanding orientation and in evenly spaced relationship with each other as the storage means moves intermittently across the supporting surface.

In some of its more limited aspects, the device embodying the principles of the invention includes a storage means in which the articles are stored directly on the supporting surface on which they are to be set up. A discharge means is mounted in the storage means for sequentially discharging articles from a free end of the storage means while the storage means is stationary. And these are means for alternately actuating the discharge means and moving the storage across the supporting, in predetermined increments of movement.

In one embodiment of the invention, a single cam type element constitutes the means by which both the article discharge means is actuated and the device itself is driven across the supporting surface in a predetermined incremental manner.

In another embodiment of the invention, the above mentioned cam type mechanism is utilized only as the means by which the device is moved across the supporting surface. Another actuating mechanism which is driven from the same source as that which drives the cam type mechanism constitutes the means for actuating the article discharge means in timed relationship with the operation of the drive means so that the discharge means is actuated only when the device is stationary.

One of the principal features of the present invention is that in both of the embodiments inventions thus far, the dominos are discharged from the storage means solely by lateral or sidewise movement thereof with respect to the broad faces of the dominos. This is accomplished by providing a discharge mechanism having a pusher means which bears against a side edge of the rearmost domino in the storage compartment, and which moves to push the domino laterally when the discharge means is actuated. The advantage of the type of movement is that is can be accomplished with much less likelihood of a domino inadvertently being tipped over and thereby knocking down dominos already set up if the one being discharged should tip in the wrong direction. In other words, considering the typical, well known shape of a domino, one can be moved laterally, while standing in an upright position on one end edge, with far greater stability than it can be moved in the direction of one or the other of the broad faces.

Another important feature of both of the embodiments mentioned above is that means are provided for arresting the lateral movement of the domino being discharged before it is released by the domino discharging means. This is accomplished by providing a suitable abutment member mounted on the side of the body member adjacent a discharge opening from the storage means which stops the lateral movement of the domino. During the brief movement that the discharge means is in the discharge position, the domino is held between the aforementioned pusher means and the abutment member. Thus, the domino is not only discharged, it is stabilized in its upright position before it is released by the discharge mechanism, so that when the entire device moves forwardly away from the domino just discharged, there is virtually no possibility that it will tip over in either a forward or rearward direction.

A further important feature of the present invention is that the device, in one embodiment, can be of modular construction so that a plurality of domino storing and discharging units may be selectively connected to and operated by a single combined drive and domino discharge means actuating unit. This permits the device of the present invention to set up a plurality of rows of dominos simultaneously.

Having thus described generally certain features of construction and operation of the present invention, it is a principal object thereof to provide a device for placing a plurality of rectangular articles such as dominos in a row in upstanding orientation and in evenly spaced relationship on a flat surface as the device moves across the surface.

Another object of the present invention is to provide a device for positioning a plurality of articles such as dominos as in the first object above which is a substantial improvement on the similar device disclosed in my above referenced U.S. patent.

A further object of the present invention is to provide a device for positioning a plurality of articles such as dominos as in the first object above in which the dominos are discharged from a storage means laterally and are held stationary to stabilize the dominos to minimize the possibility of their tipping over.

It is still another object of the present invention to provide a device for positioning a plurality of articles such as dominos as in the first object above in which a driving means and an operating means for an article discharge means constitute an integral modular unit, and an article storage and discharge means constitute another integral modular unit, and there is provision for attaching a plurality of the latter units to one of the former units so that a selected number of rows of dominos can be set up simultaneously.

These and other objects, features and advantages of the present invention will become more apparent from an understanding of the following detailed description of presently preferred embodiments of the present invention when considered in conjunction with the accompanying drawings in which.

DETAILED DESCRIPTION OF THE INVENTION

Figure 1:
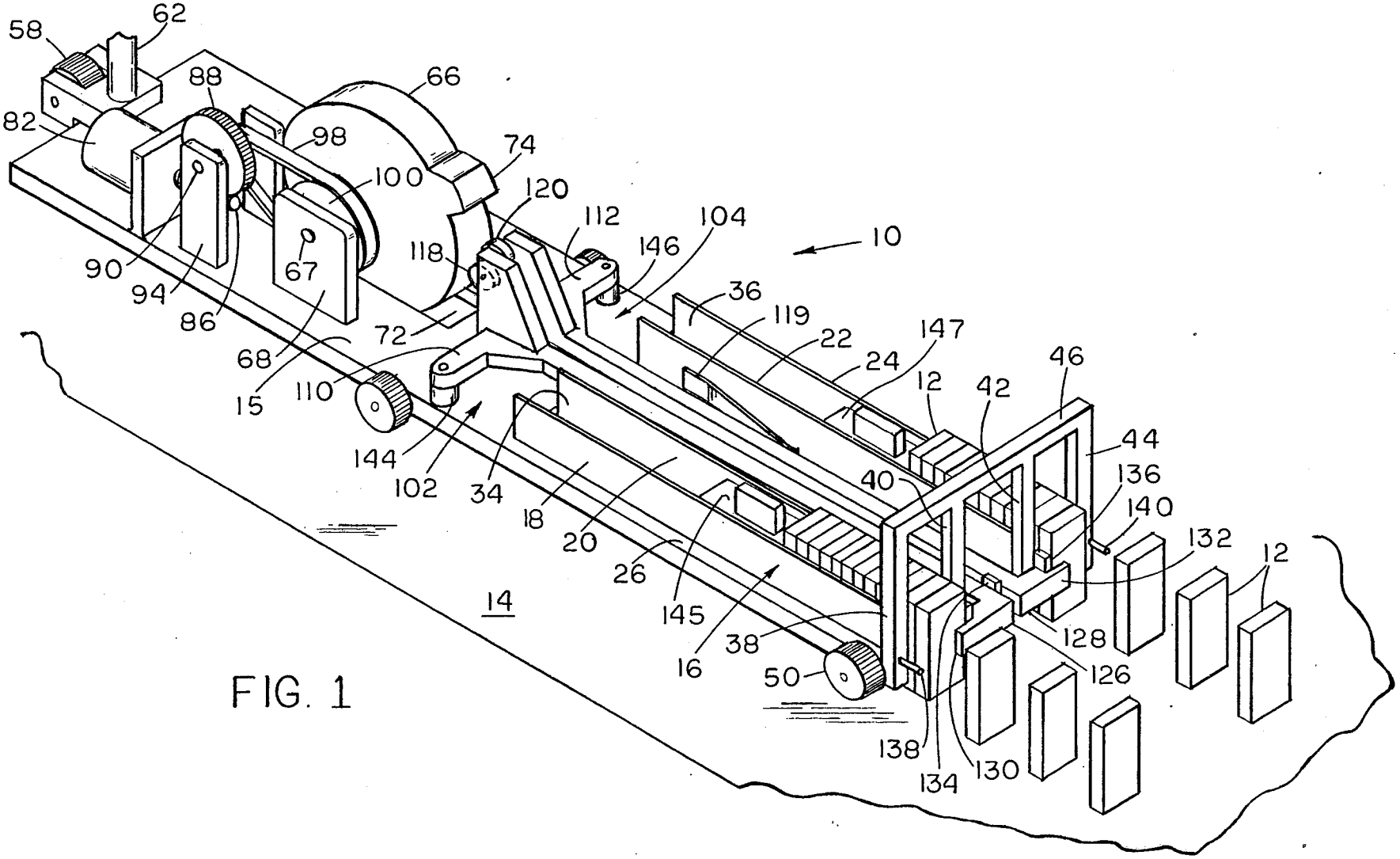
FIG. 1 is a perspective view of a device embodying the principles of the invention showing a plurality of articles already positioned in a row by the device and other articles stored in the device.
Figure 3:
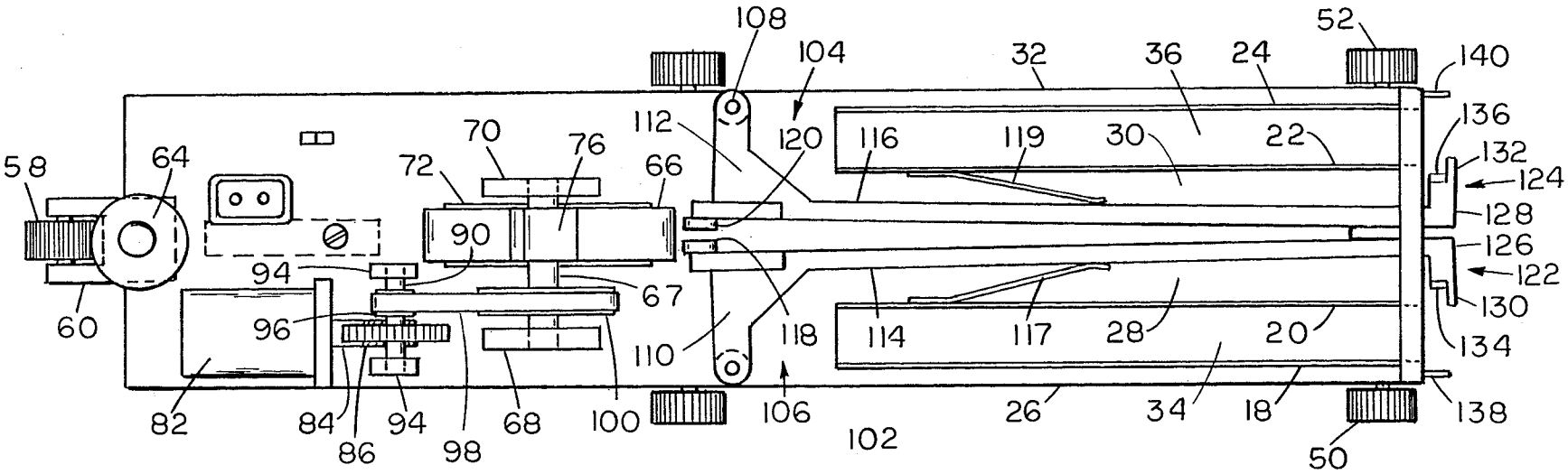
FIG. 3 is a plan view of the device shown in FIG. 1.
Figure 2:
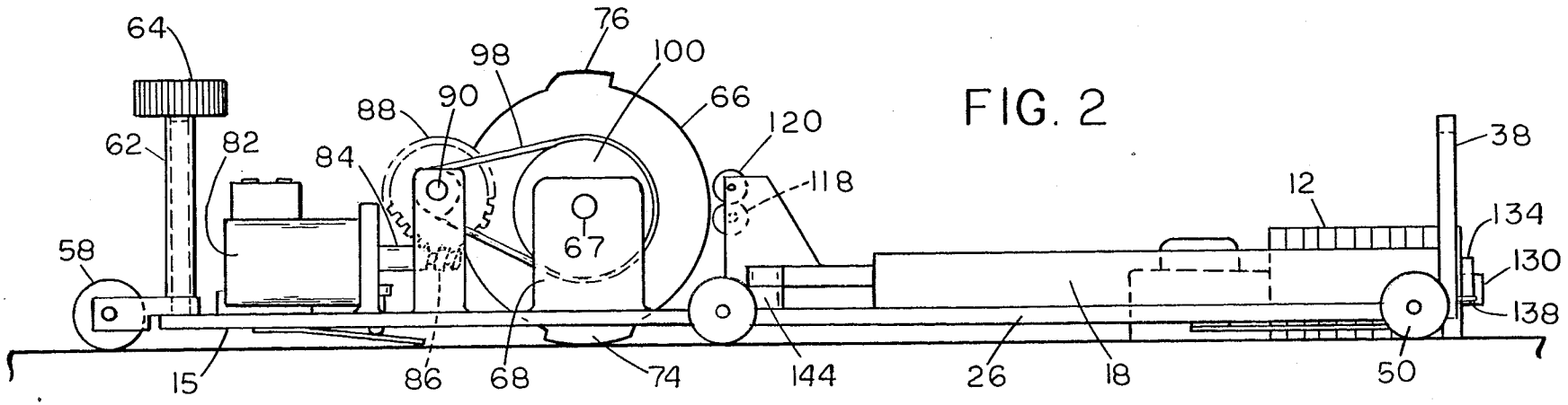
FIG. 2 is a side elevation of the device shown in FIG. 1.

Referring now to the drawings, and more particularly to FIGS. 1, 2 and 3 thereof, there is seen a device generally designated by the numeral 10 for discharging and positioning a plurality of elongate generally rectangular articles such as the dominos 12 on a flat surface 14 in upstanding orientation and in evenly spaced relationship. The device 10 includes an elongate body member 15 which may be either of unitary or modular construction as will be more fully explained below.

A portion of the body member includes an elongate article retaining means generally designated by the reference numeral 16. The retaining means 16 includes at least one pair, and preferably two pairs, of elongate wall members 18, 20, 22 and 24, each pair extending the full length of the retaining means. The wall members 18–24 are suitably secured to elongate rails 26, 28, 30 and 32 which are part of the body member, and which also extend the full length of the retaining means 16, these holding the wall members 18–24 in upstanding parallel relationship.

Each pair of wall members 18–20 and 22–24 define elongate retaining compartments 34 and 36 for storing a plurality of dominos 12 in upstanding orientation, with the broad faces of the dominos in contact with each other. It should be noted at this point that the storage compartments 34 and 36 have no bottoms, and therefore that the dominos 12 rest directly on the same surface 14 as that on which the entire device 10 rests and on which the pattern of dominos will be set up. The significance of this feature will be more clearly established herein below.

At the free end of the storage means 16 there is provided any suitable form of stabilizing framework or other form of construction for the purpose of adding rigidity to this end of the body member. In the device as disclosed, this takes the form of four upright members 38, 40, 42 and 44 which are suitably secured to the free end of the elongate portions or rails 26, 28, 30 and 32 respectively of the body member 15. A cross member 46 interconnects all of the upright members at a height which will clear the top of the dominos and allow them to pass thereunder.

In order to facilitate movement of the device 10, the body member 15 is provided with wheels 50 and 52 suitably mounted on the free end of the elongate rails 26 and 32 of the body member. Additional wheels 54 and 56 are suitably mounted on the body member 15 approximately at the longitudinal midpoint thereof. Another wheel 58 is mounted on the end of the body member 15 opposite from the wheels 50 and 52, this wheel preferably being angularly settable so as to act as a steering wheel to cause the device 10 to turn when it is in motion. Thus, this wheel is shown as being mounted in a U-shaped bracket 60 which is connected to an upright rod 62 rotatably mounted on the body member 15. A suitable finger knob 64 is provided for turning the rod 62 to set the wheel 58 at the desired angle.

In order to move the device 10 across the surface 14 in the direction of the settable wheel 58, there is provided a combined article discharge actuating and drive means which operates to alternately actuate an article discharge means yet to be described when the device 10 is stationary and to intermittently move the device 10 across the surface. In the present embodiment, this device is disclosed as being a cam means consisting of a rotatable member 66 in the form of a wheel which is carried by a shaft 67 rotatably mounted in upstanding support members 68 and 70 mounted on the body member 15. The body member 15 is provided with an aperture 72 through which a lower portion of the wheel 66 extends to a point just slightly spaced above the supporting surface 14. A pair of cam lobes 74 and 76 are suitably carried by the wheel 66 for rotation therewith, the cam lobes being spaced 180° apart and being slightly thicker than the distance between the supporting surface 14 and the lowest point of the trajectory of the wheel 66.

It will be apparent by this construction that as the wheel 66 rotates in the direction of the arrow seen in FIG. 2, the cam lobes 74 and 76 will successively engage the supporting surface 14 and will push the device 10 along the surface for a predetermined increment of movement. As soon as the cam lobes move out of contact with the supporting surface 14, the device 10 will stop moving.

It should be noted that during the brief interval when the cam lobes 74 and 76 are in contact with the supporting surface and moving the device 10, the body member 15 is lifted very slightly with the result that much of the weight of the device normally supported by the midpoint wheels 54 and 56 is removed. This allows these wheels to slip laterally with respect to the supporting surface 14 if the rotatable wheel 58 is set at an angle so that the device 10 can follow a curved path.

The rotatable member or wheel 66 is driven by a suitable drive mechanism carried by the body member 15 forwardly to the wheel 66. The drive mechanism disclosed includes an electric motor 82 having a shaft 84 which terminates in a worm gear 86. The latter drives a spur gear 88 mounted on a shaft 90 rotatably mounted in upright supports 92 and 94. A pulley 96 is mounted on the shaft 90 for rotation therewith, which drives a belt 98 which in turn drives another pulley 100 mounted on the shaft 67, thereby rotating the wheel 66.

In addition to being the means by which the device 10 is moved along the surface 14, the rotating member 66 and cam lobes 74 and 76 are also part of a discharge means for discharging dominos successively from the retaining compartments 34 and 36 while the device 10 is stationary. Again as best seen in FIGS. 1–3, a pair of L-shaped levers generally designated by the reference numerals 102 and 104, are pivotally mounted on the body member 15 as at the pivot points 106 and 108 adjacent the outer edges of the body member 15. Each lever has a short arm 110 and 112 extending from the pivot points 106 and 108 respectively toward the center of the body member 15, and a long arm 114 and 116 extending longitudinally of the body member 15 from the short arms 110 and 112 respectively toward the free end of the storage compartments 34 and 36. A pair of leaf springs 117 and 119 are secured to the wall members 20 and 22 and bear against the arms 110 and 112 respectively to urge the levers 102 and 104 to their normal positions as shown in FIG. 3. The levers 102 and 104 are provided with cam followers 118 and 120 which are suitably mounted on the levers 102 and 104 as by the blocks 106 and 108 at an elevated location which corresponds approximately with the vertical midpoint of the path of travel of the cam lobes 74 and 76 so as to be contacted by the cam lobes 74 and 76 during rotation thereof. Although not necessary, it is preferred that the cam followers 118 and 120 be mounted in a slightly different elevation, as best seen in FIG. 2, for a purpose to be clear hereinafter.

Figure 4:
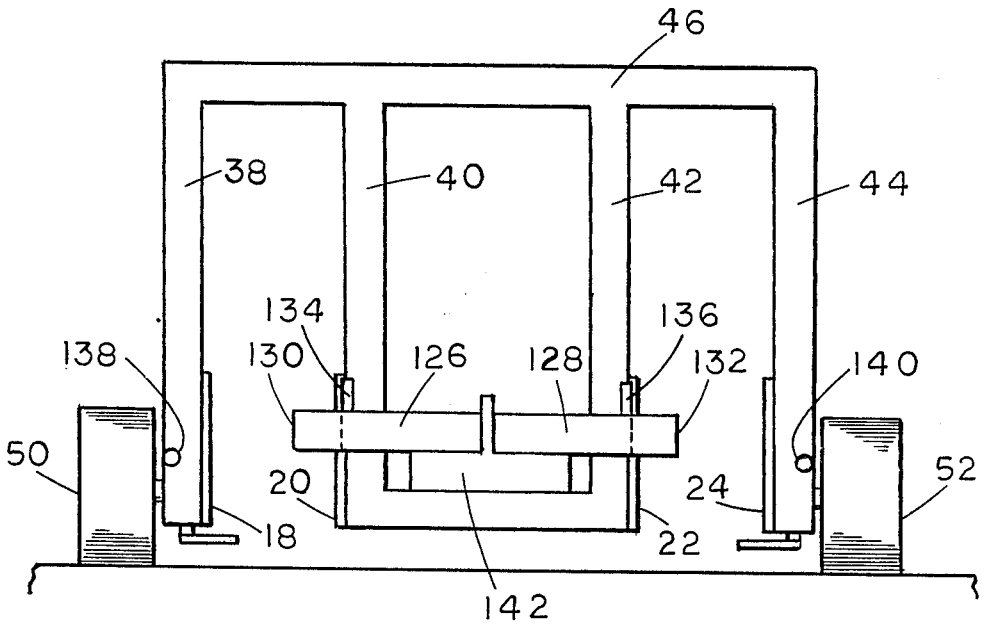
FIG. 4 is an end view of the device shown in FIG. 1.
Figure 6:
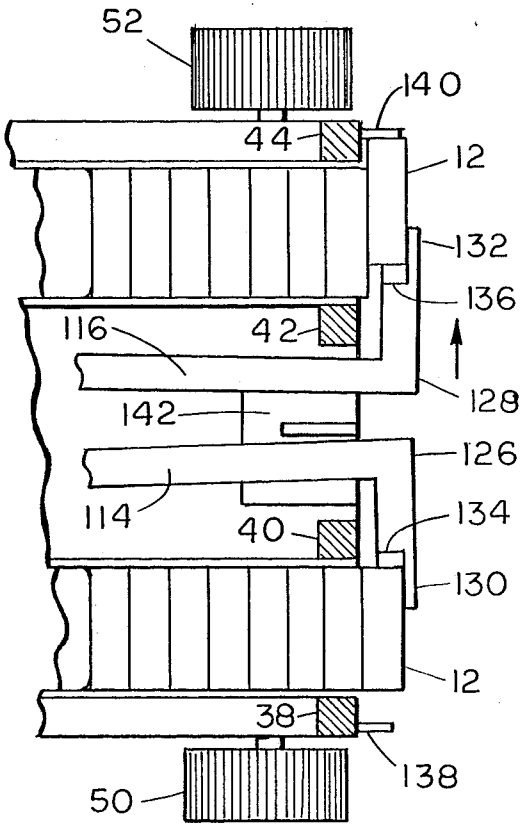
FIGS. 5 through 8 are fragmentary plan views of the article discharge mechanism showing the parts in various stages of discharging an article.
Figure 5:
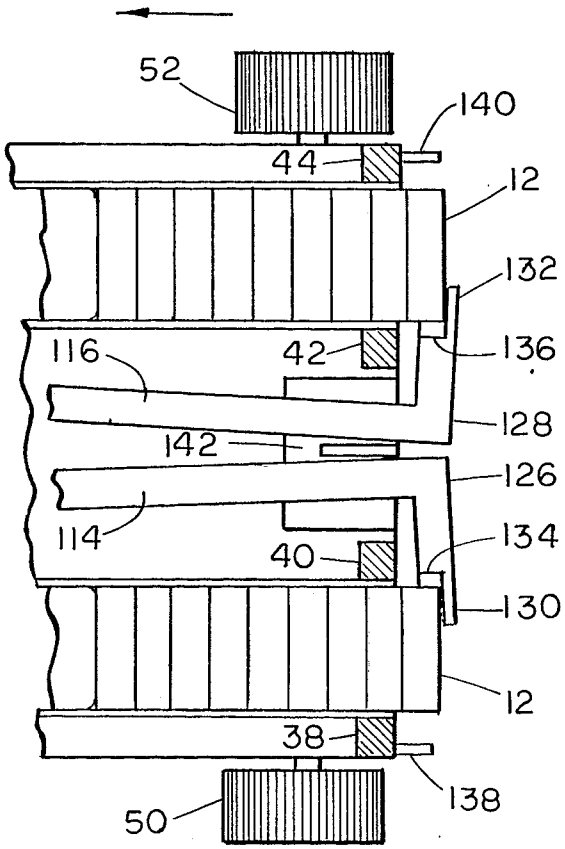
Figure 7:
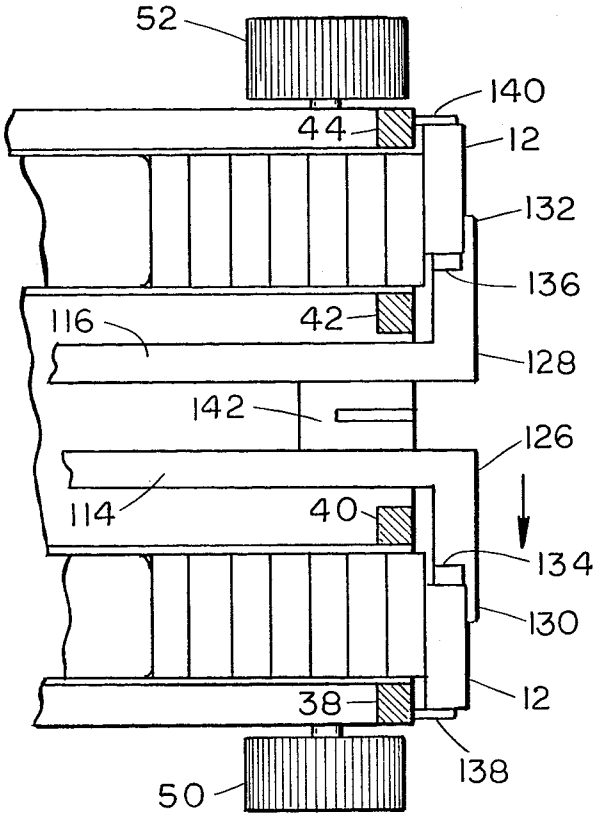

As best seen in FIGS. 1 and 3 through 6, the long arms 114 and 116 of the levers 102 and 104 are disposed in the space between the upright wall members 20 and 22, and terminate in a combined domino retaining and discharging means generally designated by the numerals 122 and 124. These function to retain dominos in the retaining compartments 34 and 36 during movement of the device 10, and to discharge dominos from the retaining compartments when the device 10 is stationary, depending on the position and direction of movement of the retaining and discharging means 122 and 124. More particularly, the means 122 and 124 comprises a lateral projection 126 and 128 which may be integrally formed with or separately attached to the end of the arms 114 and 116, the projections 126 and 128 terminating in retaining tabs 130 and 132 which are normally disposed in the path of the dominos 12 as best seen in FIGS. 1 and 7. Adjacent the tabs 130 and 132 are upstanding tabs 134 and 136 which contact the side edge of the dominos 12 to discharge them in the manner hereinafter described. A pair of stop pins 138 and 140 are mounted on the upright members 38 and 44 at a height approximately commensurate with the retaining tabs 130 and 132 to arrest the lateral movement of the dominos during discharge and to help stabilize them. As best seen in FIG. 4, a spacer member 142 is positioned on the body member 15 to support the free end of the longer arms 114 and 116 at the same height as the short arms 110 and 112 which are spaced a short distance above the body member 15 by the spacers 144 and 146 shown in FIG. 1 at the pivot points 106 and 108. Finally, a pair of generally rectangular weights 145 and 147 are positioned in the retaining channels 34 and 36 behind the forwardmost dominos 12. These weights are adapted to slide on the supporting surface as the device 10 moves so as to assure that the dominos in the retaining compartments remain upright and in contact with each other prior to being discharged.

The above described device operates in the following manner; when appropriately energized, the motor 82 drives the shaft 84 and worm gear 86 to turn the spur gear 88, shaft 90 and pulley 96. This drives the belt 98 which rotates the pulley 100 and shaft 67, which in turn rotates the wheel 66 carrying the cam lobes 74 and 76. As each cam lobe contacts the supporting surface 14, the device 10 is moved across the surface by a predetermined increment. It will be apparent that the device 10 will move twice for each revolution of the wheel 66, and that this can be adjusted by providing more or fewer cam lobes on the wheel.

As the wheel 66 rotates, the cam lobes 74 and 76 are successively brought into contact with the cam followers 118 and 120. As previously mentioned, the cam followers 118 and 120 are mounted at a slightly different vertical location with the result that the domino discharging devices are operated sequentially rather than simultaneously, thereby lessening the amount of force required to move both levers. When a cam lobe (regardless of which one it is) contacts the lower of the cam followers 118, it moves the cam follower toward the rear or domino discharge end of the device 10. This causes the lever 102 to pivot about the pivot point 106 in a direction to move the long arm 114 from the position shown in FIGS. 1, 3 and 5, which show the parts of the device in their normal positions, toward the outer edge of the body member 15 against the bias of the spring 117. This movement of the lever 102 causes the upstanding tab 134 to push laterally against the edge of the outermost domino 12 and to move it laterally in the direction of the arrow shown in FIG. 6 until the other edge of the domino abuts the stop pin 138, as seen in FIG. 6.

As the wheel 66 rotates a little further, the cam lobe moves and contacts the other cam follower 120, with the result that the other lever 104 is moved about its pivot point 108 to move a domino in the other retaining compartment laterally in the same manner as just described above. At this point, one domino from each retaining compartment will have been moved laterally to the positions show in FIG. 7.

As the wheel 66 continues to rotate, the cam lobe moves out of contact with the cam followers 118 and 120, thereby permitting both levers 102 and 104 to return to their normal positions under the bias of the springs 117 and 119. As seen in FIG. 7, in this position the end of the retaining tabs 130 and 132 are disposed inwardly of the device 10 to clear the inner edges of the dominos which have been shifted laterally. The parts are now in the positions shown in FIG. 8.

Figure 8:
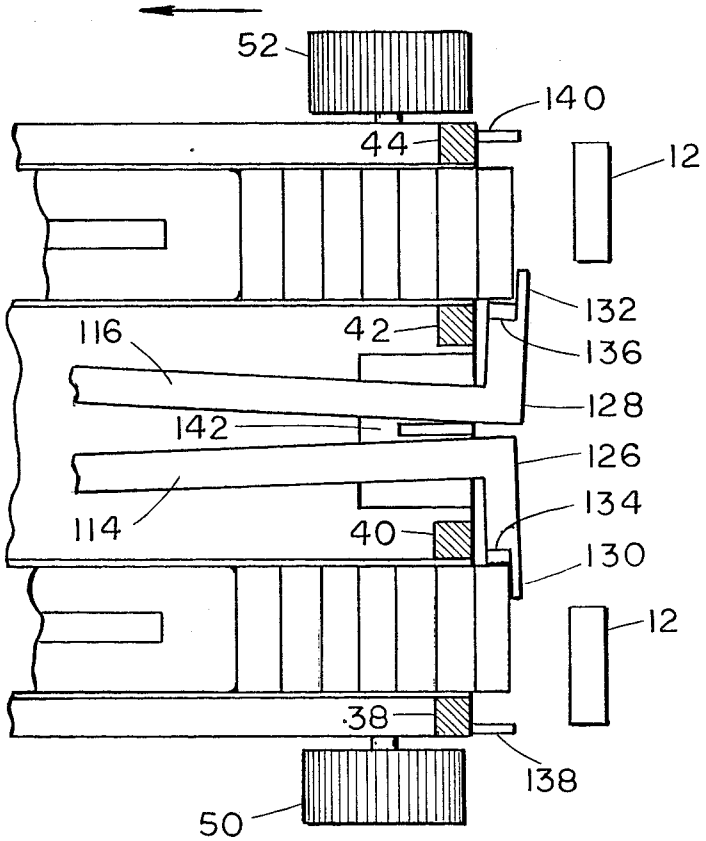

As the wheel 66 continues to rotate, the other cam lobe from the one which just made contact with the cam followers contacts the supporting surface 14 to move the device 10 in a forwardly direction. Since the dominos just moved laterally are no longer restrained by the retaining tabs 130 and 132, these dominos remain stationary as the device 10 moves away from them, leaving them standing in spaced relationship with the now rearmost dominos still in the retaining compartments as shown in FIG. 8. The above cycle of operation repeats as long as there are dominos in the retaining compartments.

Another embodiment of the invention incorporates the concept of modular construction of the domino positioning device in which the driving means and the actuating means for the discharge means are arranged together in one unit, and the domino storage and discharge means are arranged together in another unit, and a plurality of the latter units can be selectively attached to a single driving and actuating means unit. For illustrative purposes, this embodiment of the invention is shown with two domino storage and discharge units, each with dual storage and discharge capacity, attached to one drive means and actuating means unit.

Figure 9:
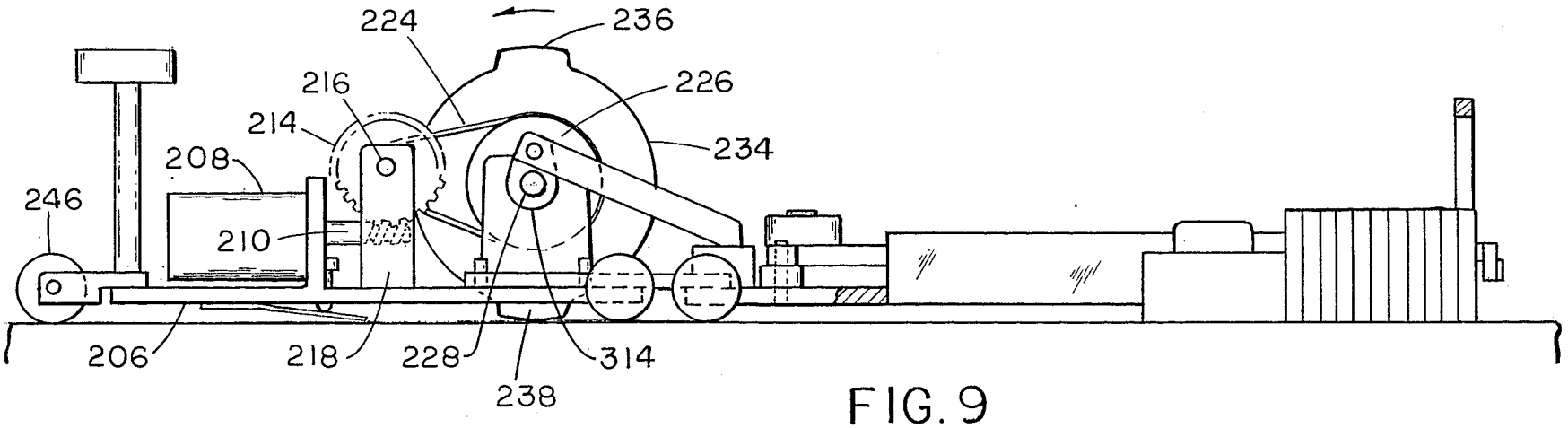
FIG. 9 is a side elevation of an alternate embodiment of the invention.
Figure 10:
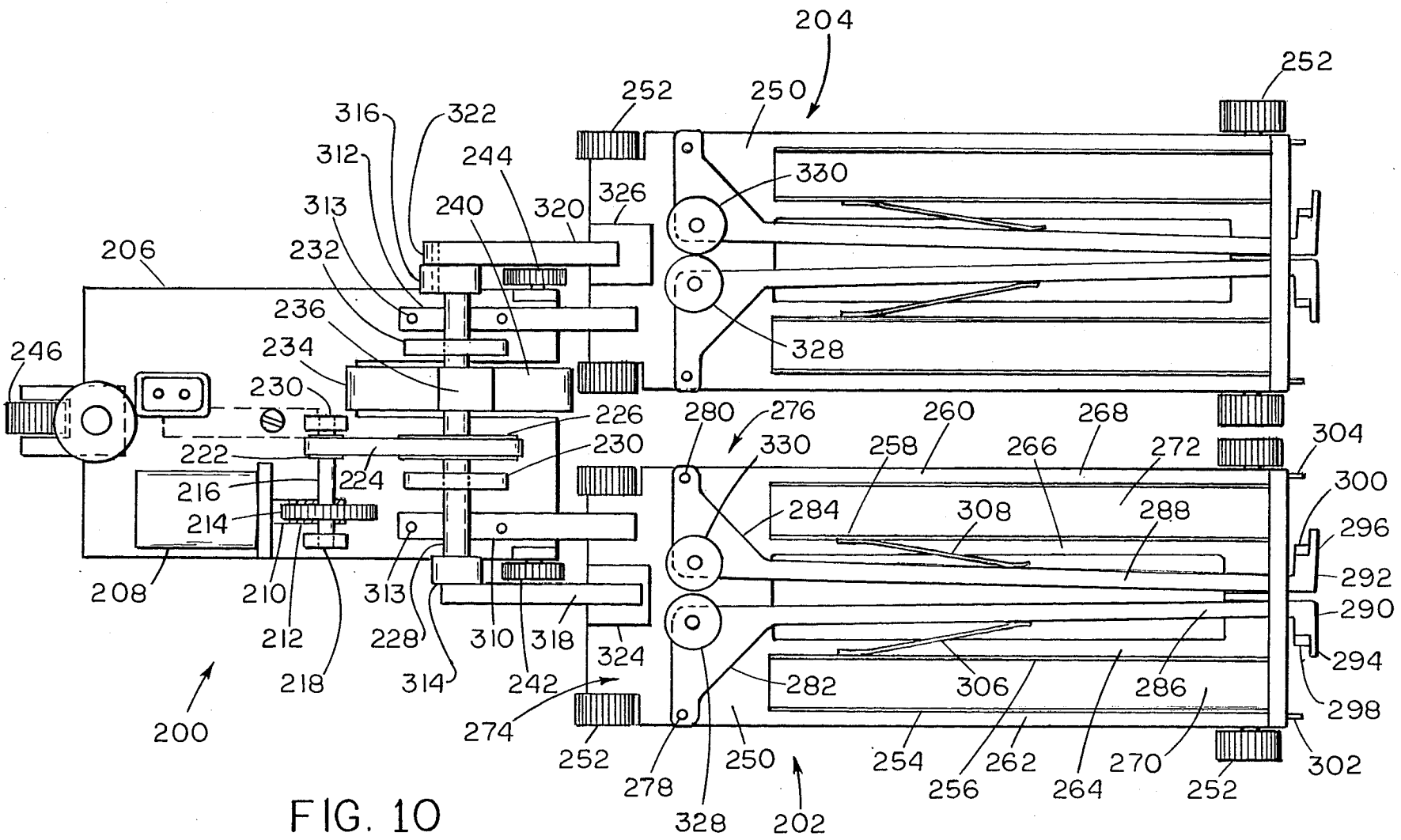
FIG. 10 is a plan view of the embodiment of the invention shown in FIG. 9.

This embodiment of the invention will be better understood with reference to FIGS. 9 and 10 which show a combined driving and actuating means unit generally designated by the numeral 200, and a pair of dual capacity domino storage and positioning units generally designated by the reference numerals 202 and 204. The driving and actuating means unit 200 is generally similar to the corresponding portion of the device 10 above described, and comprises a body member 205 on which is mounted an electric motor 208 having a shaft 210 which terminates in a worm gear 212. The latter drives a spur gear 214 mounted on a shaft 216 rotatably mounted in upright supports 218 and 220. A pulley 222 is mounted on the shaft 216 for rotation therewith which drives a belt 224 which in turn drives another pulley 226 mounted on a shaft 228 which is rotatably mounted in the upright supports 230 and 232.

A cam rotating means, such as the wheel 234 similar to the wheel 66 of the previous embodiment, is mounted on the shaft 228 for rotation therewith, and includes a pair of cam lobes 236 and 238. A recess 240 is formed in the body member 206 for the wheel 234 to extend through so that the cam lobes 236 and 238 can alternately contact the supporting surface on which the device 200 rests so as to successively move the device by a small increment as the wheel 234 rotates in the direction of the arrow shown in FIG. 9. In order to facilitate such movement, the body member 206 is provided with a pair of rear wheels 242 and 244, and a forward wheel 246 which is mounted to be set at an angle for steering purposes in the same manner as the wheel 58 of the previous embodiment.

Each of the two domino storage and ejecting units 202 and 204 are virtually identical to the corresponding components of the device 10 of the previous embodiment, with the exception of the arrangement of the cam followers as will be clearly seen below. Since the units 202 and 204 are identical to each other, they will be described simultaneously. Thus, each unit includes an elongate body member 250 supported by four wheels 252. Each body member includes elongate wall members 254, 256, 258 and 260 which are secured to elongate portions or rails 262, 264, 266 and 268 of the body member 250. The wall members, which are in upstanding parallel relationship, define a pair of elongate storage compartments 270 and 272 for storing dominos in the same manner as in the previous embodiment.

As with the previous embodiment, each storage compartment 270 and 272 is provided with a domino discharging means in the form of L-shaped levers 274 and 276 pivotally mounted on the body member 250 as at the pivot points 278 and 280. Each lever has a short arm 282 and 284 extending from the pivot points toward the center of the unit 250, and a long arm 286 and 288 extending from the short arms to the free ends of the storage compartments 270 and 272. These levers terminate in the lateral projections 290 and 292 which have retaining tabs 294 and 296 and upstanding pusher tabs 298 and 300. Also, the body member is provided with stop pins 302 and 304. Finally, the levers 274 and 276 are normally biased toward the positions shown in FIG. 10 by the leaf springs 306 and 308 attached to the wall members 256 and 258 respectively.

Each body member 250 is connected to the body member 208 of the driving and actuating means unit by any suitable connecting means which, in the disclosed embodiment, is merely a pair of bars 310 and 312 secured to the body members 250 and which are removably secured to the body members 206 as by screws 313. This provides a rigid connection between the body member 206 and the body members 250 which is necessary in order for the actuating means now to be described to operate properly.

Referring back to the shaft 228 which drives the cam lobe wheel 234, it will be seen that a pair of eccentric cranks 314 and 316 are mounted on the shaft 228 for rotation therewith, the cranks being disposed outwardly of the upright supports 230 and 232. A pair of push rods 318 and 320 are rotatably connected as by the pins 322 to the cranks 314 and 316 respectively, the push rods extending across the gap between the body members 206 and the body members 250. The opposite ends of the push rods 318 and 320 rest on supporting blocks 324 and 326 respectively located on the body members 250.

Each lever 274 and 276 is provided with a suitable abutment member 328 and 330, which in the disclosed embodiment is a pair of wheels mounted on the levers 274 and 276 respectively adjacent the juncture between the short arms and the along arms. It will be apparent that as the eccentric cranks 314 and 316 rotate, the push rods 318 and 320 abut the wheels 328 and 330 to cause the levers 274 and 276 to pivot about the pivot points and thereby to discharge dominos in the manner described in the previous embodiment.

Figure 11:
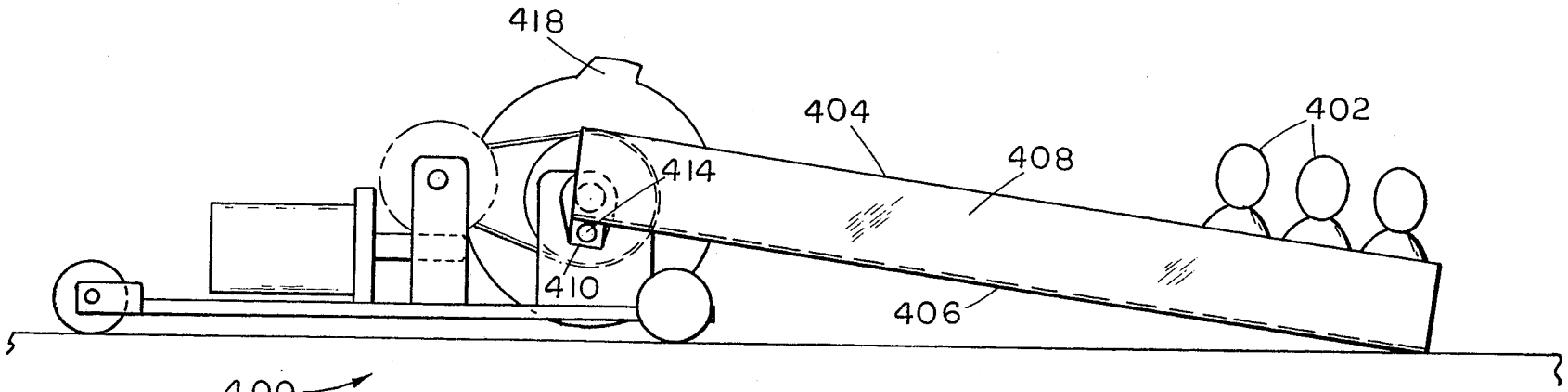
FIGS. 11 and 12 are side elevations of a still further embodiment of the invention showing certain parts of this embodiment in different positions in discharging article.
Figure 12:
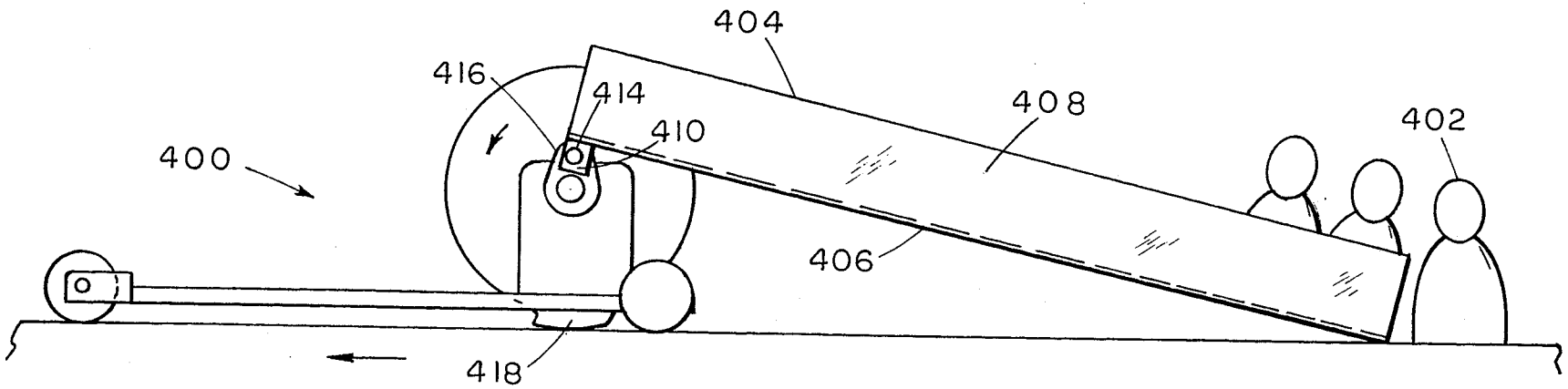

FIGS. 11 and 12 illustrate still another embodiment of the invention in which a driving and actuating means unit similar to the corresponding modular unit of the embodiment just described is utilized both to move the device of this embodiment across a flat surface and to actuate a pair of movable ramps on which a plurality of different shaped articles are stored for positioning on the flat surface. This embodiment of the invention is utilized to store articles of irregular configuration which are to be positioned in a row in spaced relationship with each other, but where it is not essential that the spaced relationship be uniform from one article to the next. A typical example of the type of articles for which this embodiment of the invention would be appropriate is small toy soldiers which have a flat base which supports the toy soldier in an upright position. It will be recognized, of course, that any small object having a flat base can be accommodated by this embodiment of the invention.

As seen in FIGS. 11 and 12, a modular unit generally designated by the numeral 400 functions to drive the device across a flat supporting surface and to actuate an article positioning means. With respect to the driving function, the modular unit 400 is an exact duplicate of the modular unit 200 which forms part of the previously described embodiment of the invention, and therefore need not again be described in detail.

The principal difference between this embodiment and the previous embodiment resides in the means by which the articles are positioned on the supporting surface. Specifically, the articles, designated by the numeral 402, are stored adjacent one another in a pair of substantially channel shaped ramps 404, each of which has a flat bottom 406 and a pair of upstanding side walls 408. The ramps 404 are wide enough to accommodate articles such as typical toy soldiers, and are long enough to accommodate a substantial plurality of such articles, although there is a practical limit to the length of the ramps as will be seen. Each ramp has a tab 410 secured to one end of one side wall, the tab projecting downwardly to accommodate an aperture through which a pin 414 passes to secure the tab to the outer end of an eccentric crank 416. This construction is the same for both ramps.

In operation, the eccentric cranks 416 are rotated in exactly the same manner as the eccentric cranks 314 and 316 in the previous embodiment. When the free end of a crank is at its lowest position, the corresponding ramp is at its lowest inclination with respect to horizontal, as seen in FIG. 11. On the other hand, when the eccentric crank is rotated 180° to its highest position, the channel is at its steepest inclination with respect to horizontal, as seen in FIG. 12. The difference in the angle of inclination between the FIG. 11 position and the FIG. 12 position is sufficient to overcome the frictional resistance to movement between the bottom of the articles 402 and the bottom 406 of the channel 408, with the result that the articles will slide down the channel when it is in the FIG. 12 position, but not when it is in the FIG. 11 position.

It should be noted that in this embodiment of the invention, there is only one cam lobe 418 to move the device incrementally across the supporting surface since both of the ramps are connected to the eccentric cranks 416 to move up and down at the same time, thereby positioning articles on the supporting surface simultaneously. It would be possible to offset the eccentric cranks 416 by 180° so that one ramp would move up to its highest position while the other ramp is moving down to its lowest position, with the result that articles would be positioned alternately from each ramp. In this arrangement, it would be necessary to have two cam lobes 418 so that the device would move forward each time a ramp is at its steepest inclination. Also, in this arrangement the articles would be positioned closer together than in the other arrangement. In either case, articles will be positioned each time one slides to the bottom of a ramp and the device moves forwardly so that the article slides off the ramp and remains stationary on the supporting surface.

What is claimed is:

1. A device for positioning a plurality of generally elongate articles having two planar faces and four planar edges enclosing said faces on a flat surface in an upstanding orientation and in evenly spaced relationship with each other, said device comprising:

A. elongate article retaining means for retaining a plurality of said articles in an upstanding orientation with each of said articles having one of said edges resting on the surface on which said articles are to be positioned in spaced relationship with each other, B. discharge means mounted in said retaining means for sequentially discharging said articles from one end of said retaining means so that said articles remain in said upstanding orientation while said retaining means is stationary relative to said surface, and C. means for alternately actuating said discharge means and moving said retaining means across said surface in predetermined increments of movement, whereby said articles are positioned on said surface in evenly spaced relationship.

2. A device as set forth in claim 1 wherein said means for alternately actuating said discharge means and moving said retaining means comprises:

A. rotatable cam means mounted on said device adjacent said article retaining means for alternately actuating said discharge means and contacting said surface, and B. drive means for rotating said cam means.

3. A device as set forth in claim 2 wherein said discharge means includes cam follower means mounted on said discharge means in position to be intermittently contacted by said cam means during rotation thereof to activate said discharge means.

4. A device as set forth in claim 3 wherein said rotatable cam means comprises a cam lobe operable to engage said cam follower means during one portion of the rotation of said cam means and to engage said surface during another portion of the rotation of said cam means whereby said discharge means is operable to discharge an article only when said device is stationary.

5. A device as set forth in claim 1 wherein said retaining means comprises: at least one pair of elongate rails defining therebetween a channel for receiving and holding therein a plurality of said articles in an upstanding orientation with said articles resting on said one of said edges on said flat surface, the end of said rails which trails with respect to the direction of movement of said device defining a discharge opening through which said articles are discharged by said discharge means.

6. A device as set forth in claim 5 wherein said discharge means comprises:

A. at least one L-shaped lever pivotally mounted on one of said rails adjacent the end thereof opposite from said trailing end, said lever having a short arm extending from said one rail where said lever is pivotally mounted across said channel, and a long arm extending from said short arm along the length of said channel, and B. means mounted on the free end of said long arm of said lever for alternately obstructing passage of an article through said discharge opening and discharging an article through said opening depending on the pivotal position of said lever.

7. A device as set forth in claim 6 wherein said means for alternately obstructing passage of an article through said discharge opening and discharging an article therethrough comprises a laterally extending projection on the free end of said long arm, said projection having first tab means positioned to contact the rear face of the rear most article in said storage compartment to retain said article when said lever is in a normal position, and second tab means for moving said rear most article laterally of said storage compartment where said lever is moved to its discharge position.

8. A device as set forth in claim 7 wherein said discharge means further includes abutment means mounted adjacent the free end of said rails in position to obstruct lateral movement of said rear most article after said lever has moved from said normal position to said discharge position to thereby stabilize said article in said laterally displaced position while still being held by said discharge means.

9. A device as set forth in claim 1 wherein said retaining means comprises two pairs of elongate rails defining therebetween two channels for receiving and holding therein a plurality of said articles in upstanding orientation with said articles resting on said one of said edges on said flat surface, the end of said rails which trail with respect to the direction of movement of said device defining a discharge opening from each retaining compartment through which said articles are discharged by said discharge means therefor forming two parallel rows of said articles simultaneously.

10. A device as set forth in claim 9 wherein said discharge means comprises:

A. a pair of L-shaped levers pivotally mounted on the two outermost rails adjacent the ends thereof opposite from said trailing end, said levers having short arms extending from said outermost rails where said levers are pivotally mounted across said retaining channels, and long arms extending from said short arms along the length of said channels, and B. means mounted on the free ends of said levers for alternately obstructing passage of articles through said discharge openings and discharging articles therethrough depending on the pivotal position of said levers.

11. A device as set forth in claim 5 wherein said means for alternately actuating said discharge means and moving said storage means comprises:

A. rotatable cam means mounted on said device adjacent said opposite end of said rails, said cam means being positioned to contact said flat surface during a portion of rotation thereof to move said device, B. cam follower means mounted on said lever in position to be contacted by said cam means during another portion of rotation thereof to pivotally move said lever between said article obstruction position and said article discharging position, and C. drive means for rotating said cam means whereby said articles are moved as a group across said flat surface during movement of said device and the rear most article is discharged from said channel when said device is stationary.

12. A device for placing a plurality of generally elongate articles having two planar faces and four planar edges enclosing said faces on a flat surface in an upstanding orientation and in space relationship with each other, said device comprising:

A. elongate article retaining means for retaining a plurality of said articles in an upstanding orientation with each of said articles having one of said edges resting on the surface on which said articles are to be positioned in spaced relationship with each other, B. discharge means mounted in said retaining means for sequentially discharging said articles from one end of said retaining means so that said articles remain in said upstanding orientation while said retaining means is stationary relative to said surface, C. actuating means for intermittently operating said discharge means to discharge said articles sequentially, and D. drive means for intermittently moving said retaining means across said surface in predetermined increments of movement, whereby said articles are deposited on surface in spaced relationship.

13. A device as set forth in claim 12 wherein said drive means comprises:

A. rotatable pusher means mounted on said device adjacent said article storage means for successively contacting said surface only during a small increment of rotation thereof to move said device intermittently when said pusher means contacts said surface, and B. means for rotating said rotatable pusher means.

14. A device as set forth in claim 13 wherein said actuating means for intermittently operating said discharge means comprises:

A. eccentric crank means mounted coaxially with said rotatable pusher means but laterally offset with respect thereto, B. a push rod pivotally connected to said eccentric crank means, and C. means mounted on said discharge means in position to be successively contacted by said push rod as the latter is moved forwardly and rearwardly in response to rotation of said eccentric crank means.

15. A device for placing a plurality of parallel rows of generally elongate articles having two planar faces and four planar edges enclosing said faces on a flat surface with the articles in an evenly spaced upstanding relationship with each other, said device comprising:

A. a first generally flat body member supported by wheels for movement across said flat surface, B. drive means mounted on said body member for intermittently moving said body member across said surface in predetermined increments of movement, C. a plurality of second, elongate, generally rectangular, flat body members connected to said first body members for movement therewith, each of said second body members including 1. elongate article retaining means for retaining a plurality of said articles in an upstanding orientation with each of said articles having one of said edges resting on said surface in face to face relationship with each other, and 2. discharge means mounted in said retaining means for sequentially discharging said articles from one end of said retaining means so that said articles remain in said upstanding orientation while said retaining means is stationary relative to said surface, and D. actuating means mounted on said first body member and operatively connected to said discharge means for operating the latter to discharge at least two of said articles substantially simultaneously when said device is stationary, whereby said articles are discharged successively to form at least two parallel rows of said articles in an evenly spaced relationship.

16. A device as set forth in claim 15 wherein said second body member are connected to said first body member by means which permit said second body members to be selectively and removably connected to said first body member.

17. A device as set forth in claim 16 wherein said actuating means comprises:

A. a plurality of movable pusher members spaced laterally across said first body in position to contact said discharge means on each of said second body members, and B. means for reciprocally moving all of said pusher members.

18. A device as set forth in claim 17 wherein said means for reciprocally moving said pusher members comprises means for moving said pusher members alternately in succession so that said discharge means are not actuated simultaneously.

* * * * *